US008641434B2

(12) United States Patent
Siebens et al.

(10) Patent No.: US 8,641,434 B2
(45) Date of Patent: Feb. 4, 2014

(54) ROTATABLE FEEDTHRU INSERT

(75) Inventors: Larry N. Siebens, Asbury, NJ (US); Alan D. Borgstrom, Hackettstown, NJ (US)

(73) Assignee: Thomas & Betts International, Inc, Wilmington, DE (US)

( * ) Notice: Subject to any disclaimer, the term of this patent is extended or adjusted under 35 U.S.C. 154(b) by 390 days.

(21) Appl. No.: 13/176,146

(22) Filed: Jul. 5, 2011

(65) Prior Publication Data

US 2012/0018217 A1 Jan. 26, 2012

Related U.S. Application Data

(60) Provisional application No. 61/366,250, filed on Jul. 21, 2010.

(51) Int. Cl.
*H01R 13/62* (2006.01)

(52) U.S. Cl.
USPC ..... 439/181; 439/364; 439/921

(58) Field of Classification Search
USPC ..... 439/181, 186, 921, 364
See application file for complete search history.

(56) References Cited

U.S. PATENT DOCUMENTS

| | | | | |
|---|---|---|---|---|
| 3,959,869 | A | 6/1976 | Wyman et al. | |
| 4,202,591 | A | 5/1980 | Borgstrom | |
| 4,203,641 | A | 5/1980 | Siebens | |
| 4,353,611 | A | 10/1982 | Siebens et al. | |
| 4,354,721 | A | 10/1982 | Luzzi | |
| 4,360,967 | A | 11/1982 | Luzzi et al. | |
| 4,611,093 | A | 9/1986 | Farmer et al. | |
| 4,776,089 | A | 10/1988 | Schoenwetter et al. | |
| 4,779,341 | A | 10/1988 | Roscizewski | |
| 4,857,021 | A | 8/1989 | Boliver et al. | |
| 4,865,559 | A | 9/1989 | Clabburn | |
| 4,946,393 | A | 8/1990 | Borgstrom et al. | |
| 5,041,004 | A | 8/1991 | Waldorf | |
| 5,421,750 | A | 6/1995 | Crotty | |
| 6,332,785 | B1 | 12/2001 | Muench, Jr. et al. | |
| 7,029,305 | B2 | 4/2006 | Weidner | |
| 7,503,785 | B2 | 3/2009 | Stepniak | |
| 7,556,540 | B2 | 7/2009 | Siebens et al. | |
| 7,972,155 | B1 * | 7/2011 | Siebens | 439/181 |
| 8,449,310 | B2 * | 5/2013 | Siebens | 439/181 |
| 2009/0088014 | A1 * | 4/2009 | Hughes et al. | 439/296 |
| 2012/0018217 | A1 * | 1/2012 | Siebens et al. | 174/659 |

* cited by examiner

*Primary Examiner* — James Harvey
(74) *Attorney, Agent, or Firm* — Snyder, Clark, Lesch & Chung, LLP

(57) ABSTRACT

An electrical connector feedthru insert assembly may include a connector body having a first leg projecting from the body in a first direction and second and third legs projecting from the body in a second direction substantially opposing the first direction. The first leg may be configured for insertion into a bushing well in a transformer, the bushing well including a conductive stud therein. The first leg may include a longitudinal bore extending therethrough configured for alignment with the conductive stud in the bushing well upon insertion of the first leg into the bushing well, the longitudinal bore having a bolt passage portion and a first shoulder portion. The feedthru insert assembly may further include a bolt sized for insertion into the longitudinal bore and including a tool engagement shoulder portion to engage the first shoulder portion of the longitudinal bore. Application of rotational force to the tool engagement shoulder portion may cause the bolt to threadingly engage the conductive stud.

17 Claims, 4 Drawing Sheets

ROTATABLE FEEDTHRU INSERT

CROSS-REFERENCE TO RELATED APPLICATION

This application claims priority under 35. U.S.C. §119, based on U.S. Provisional Patent Application No. 61/366,250 filed Jul. 21, 2010, the disclosure of which is hereby incorporated by reference herein.

BACKGROUND OF THE INVENTION present invention relates to electrical cable connectors, such as loadbreak connectors and deadbreak connectors. More particularly, aspects described herein relate to a feedthru insert (also referred to as a feedthrough or double bushing) for connecting to an electrical switchgear assembly.

Electrical distribution systems such as those used to provide electrical power to commercial and residential dwellings may incorporate feedthru inserts assemblies to couple high-voltage power feeder cables to the input connections or terminals on electrical distribution transformers. Feedthru inserts typically include two or more upright legs conductively coupled to an opposing leg by a cross bar. The single leg side is coupled to the transformer and the upright legs are then coupled to elbow devices or the like. Using feedthru inserts eliminates unprotected exposed electrical bus elements, connected between the transformer input connections and the primary windings within the transformer casings, and provides a more compact arrangement of the transformer installations and all of the associated connectors and cable connections therewith.

Unfortunately, when the conventional feedthru inserts are torqued into fixed operative threadable engagement with a corresponding transformer bushing well receptacle, the position of upright legs of the feedthru insert are often not suitably aligned to interface with corresponding elbow connectors to facilitate a connection therebetween.

Prior attempts to solve this problem have included incorporating torque limiting elements within the feedthru inserts, such that rotation of the insert in a predetermined direction after assembly neither adversely increases or unduly reduces the amount of torque applied to the interface between the bushing well and the insert. Unfortunately, these prior attempts have failed to provide adequate performance at an acceptable cost.

DETAILED DESCRIPTION OF THE PREFERRED EMBODIMENTS

The following detailed description refers to the accompanying drawings. The same reference numbers in different drawings may identify the same or similar elements.

Figure 1:
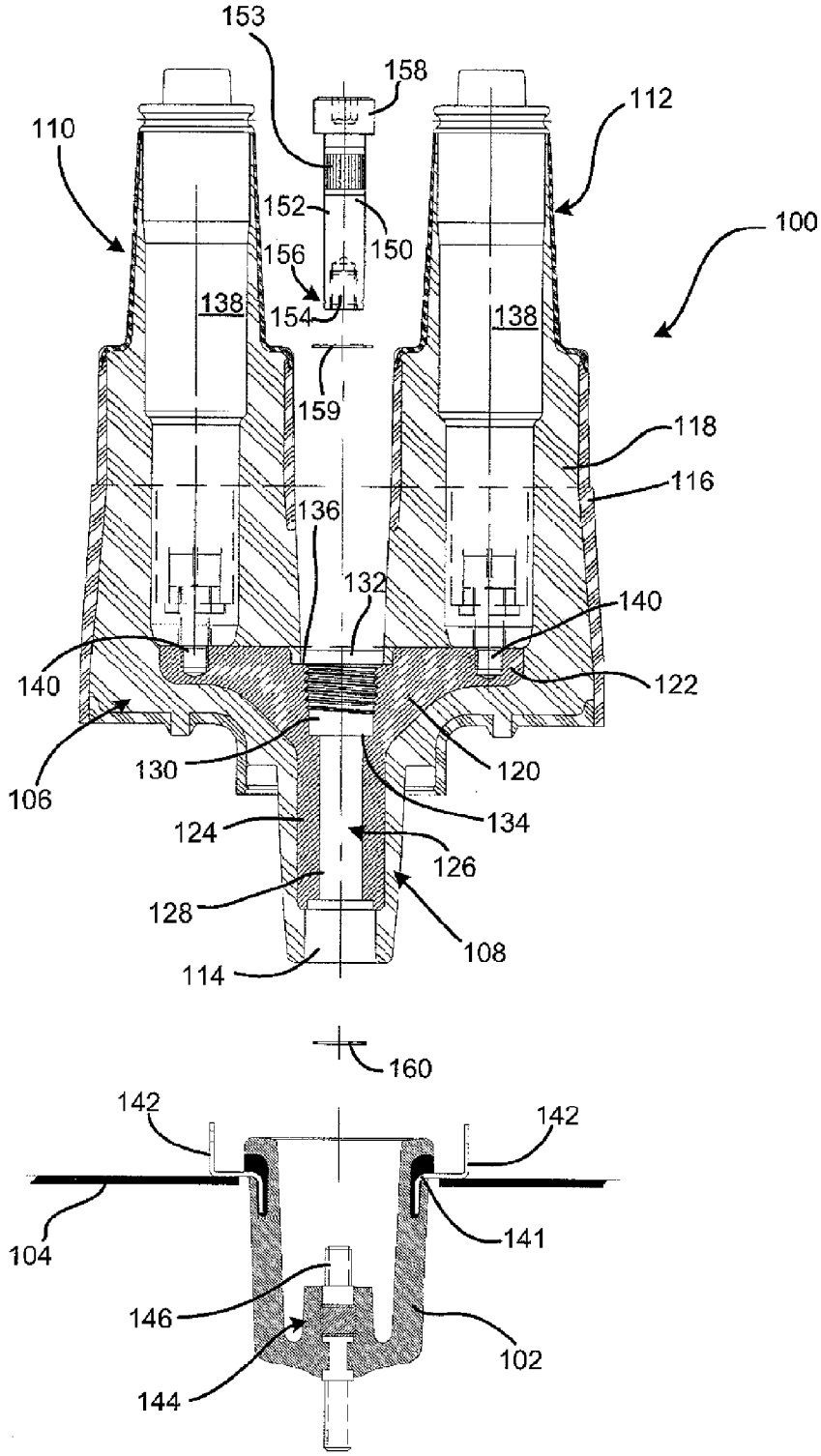
FIG. 1 is an exploded, schematic cross-sectional diagram illustrating an feedthru insert assembly consistent with implementations described herein.

FIG. 1 is an exploded, schematic, cross-sectional diagram, illustrating a feedthru insert assembly 100 consistent with implementations described herein. As shown, feedthru insert assembly 100 is configured for secure attachment to a bushing well 102 mounted in an electrical distribution transformer housing 104. As shown in FIG. 1, feedthru insert assembly 100 may include a body portion 106, a first leg 108 extending downwardly from body portion 106, and second and third legs 110 and 112, respectively, extending upwardly from body portion 106 substantially opposing first leg 108. In some implementations, first leg 108 may be formed substantially concentrically with body portion 106 (e.g., centered) such that a longitudinal axis of first leg 108 projects between second and third legs 110/112.

In one implementation, each of legs 108-112 may be substantially frusto-conically shaped to facilitate secure connection to corresponding switchgear devices, such as power cable elbows, grounding devices, surge arrestors, bushing wells, etc. More specifically, first leg 108 may include a longitudinal bore 114 therein that is concentric with the longitudinal axis of first leg 108.

Feedthru insert assembly 100 may include an electrically conductive outer shield 116 formed from, for example, a conductive or semi-conductive peroxide-cured synthetic rubber, such as EPDM (ethylene-propylene-dienemonomer). Within shield 116, feedthru insert assembly 100 may include an insulative inner housing 118, typically molded from an insulative rubber, silicon, or epoxy material. Within insulative inner housing 118, feedthru insert assembly 100 may include a conductive T-bar portion 120 that includes an upper bar portion 122 and a lower portion 124 extending into longitudinal bore 114 in first leg 108. In some implementations, T-bar portion 120 may be formed of a conductive material, such as copper, aluminum, or the like.

As shown in FIG. 1, T-bar portion 120 may include a bore 126 extending therethrough concentrically with longitudinal bore 114. Bore 126 may include a lower bolt passage portion 128, an upper threaded portion 130, and a top annular portion 132. In one implementation, upper threaded portion 132 may include an outside diameter larger than an outside diameter of bolt passage portion 128, forming a first annular shoulder portion 134. Similarly, top annular portion 132 may include an outside diameter larger than an outside diameter of upper threaded portion 130, forming a second annular shoulder portion 136.

Each of second and third legs 110/112 may include longitudinal cavities therein configured to receive conductive contact sleeves 138. As shown in FIG. 1, conductive contact sleeves 138 may be conductively coupled to T-bar portion 120 via contact studs 140.

Bushing well 102 may include a substantially cup-shaped configuration corresponding to the configuration of first leg 108. Bushing well 102 may be mounted within transformer housing 104 via a mounting bracket 141. In some implementations, mounting bracket 141 may be molded into an outer housing of bushing well 102 and may be welded or otherwise secured to transformer housing 104. In addition, mounting bracket 141 may include a number of bailing tabs 142 (two of which are shown in FIG. 1). As described in detail below with respect to FIGS. 4A-4C, bailing tabs 142 may be configured to receive bailing hooks to secure feedthru insert assembly 100 to transformer housing 104 during installation thereof.

Bushing well 102 may further include a stud portion 144 configured to receive longitudinal bore 114 and/or T-bar bore 126 thereon. Further, stud portion 144 may include a conductive stud 146 projecting from stud portion 144 and conductively coupled to electrical components within transformer housing 104. As described below, conductive stud 146 may include external threads for facilitating securing of feedthru insert assembly 100 to bushing well 102. Conductive stud 146 may be configured to extend within T-bar bore 126 during assembly of feedthru insert assembly 100.

Figure 2:
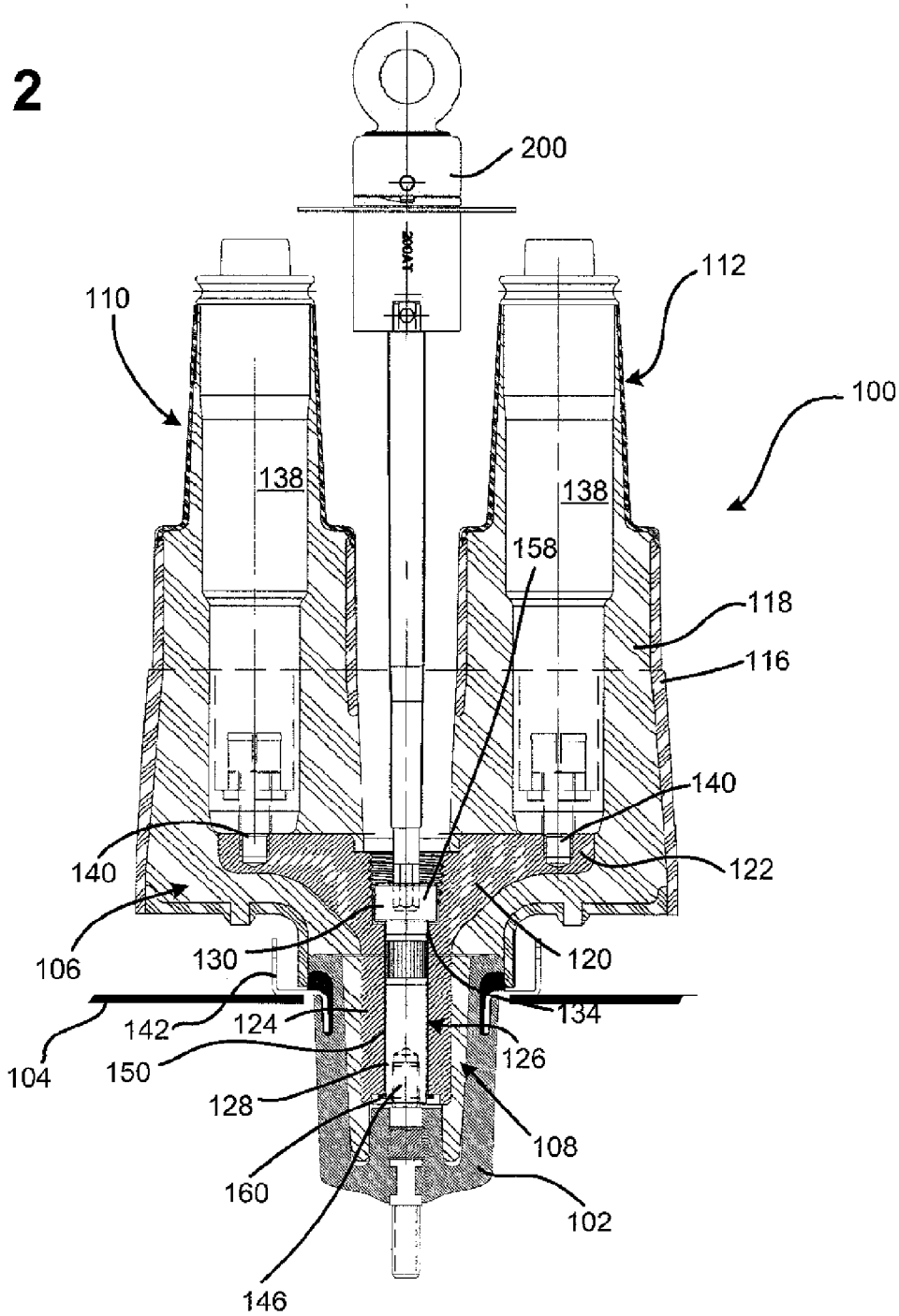
FIG. 2 is a schematic, cross-sectional diagram of the feedthru insert assembly of FIG. 1 during installation into a bushing well.

Feedthru bolt 150 may be configured for insertion into T-bar bore 126. Feedthru bolt 150 may include a cylindrical body portion 152, a louvered contact portion 153, a threaded stud receiving portion 154, a retaining ring groove 156, and a tool engagement shoulder portion 158. As shown in FIG. 1, tool engagement shoulder portion 158 may include an outside diameter larger than an outside diameter of cylindrical body portion 152 and sized to fit within first annular shoulder portion 134 in upper threaded portion 132 of T-bar bore 126. As shown in FIG. 2, louvered contact portion 153 may be configured to transfer power from feedthru bolt 150 to T-bar bore 126 in T-bar portion 120. Upon installation of feedthru bolt 150 into T-bar bore 126, threaded stud receiving portion 154 may extend into a lowermost portion of T-bar bore 126 for engaging conductive stud 146 in bushing well 102.

In some implementations, a washer 159 may be provided between first annular shoulder portion 134 of feedthru insert assembly 100 and tool engagement shoulder portion 158. Washer 159 may provide a smooth or relatively flat interface between bolt 150 and an upper surface of tool engagement shoulder portion 158.

Retaining ring groove 156 may include an annular groove in an outer surface of cylindrical body portion 152 spaced from tool engagement shoulder portion 158 such that retaining ring groove 156 extends outside of T-bar bore 126 when feedthru bolt 150 is inserted into T-bare bore 126. A retaining ring 160 may be snapped into retaining ring groove 156 when feedthru bolt 150 is inserted into T-bar bore 126, thereby securing feedthru bolt 150 to feedthru insert assembly 100 and presenting displacement and loss thereof during transport and prior to installation. Moreover, given the substantially cylindrical configuration of T-bar bore 126, feedthru bolt 150, and tool engagement shoulder portion 158, legs 110/112 may be rotated freely about feedthru bolt 150 prior to installation of feedthru insert assembly 100 in bushing well 102.

FIG. 2 is a schematic, cross-sectional diagram, illustrating feedthru insert assembly 100 during installation into bushing well 102. As shown in FIG. 2, feedthru bolt 150 has been inserted into T-bar bore 126, such that a lower shoulder portion of tool engagement shoulder portion 158 abuts first annular shoulder portion 134 of T-bar bore 126. Retaining ring 160 has been fitted within ring retaining groove 156 to secure feedthru bolt 150 to feedthru insert assembly 100.

Furthermore, as shown in FIG. 2, threaded stud receiving portion 154 of feedthru bolt 150 has been matingly threaded onto threaded conductive stud 146. Consistent with implementations described herein, legs 110/112 may be rotated about bolt 150 into a desired orientation prior to tightening of bolt 150 to bushing well 102. More specifically, body portion 106 is independent of feedthru bolt 150, thereby allowing 0°-360° rotation of feedthru insert assembly 100 about bolt 150 prior to tightening of bolt 150 to bushing well 102. Application of torque, such as via torque applied to tool engagement shoulder portion 158 via a tool 200, may cause bolt 150 to rotate relative to conductive stud 146, thereby securing feedthru insert assembly 100 to bushing well 102.

Consistent with implementations described herein, tool 200 (also referred to herein as torque limiting tool 200) may be configured to only apply defined or selected quantities of torque to bolt 150. In some implementations, tool 200 may be task-specific and may be configured to apply only a specific amount of torque, depending on the particular task for which it has been manufactured. For example, tool 200 may include a 200 Amp loadbreak torque limited tool configured to apply approximately 13 pound feet of torque. Continued rotation of tool 200 following application of the designed or preconfigured amount of torque causes tool 200 to cease applying torque to feedthru bolt 150. In other implementations, configurable torque limiting tools may be used, in which a user sets or configures the tool to apply a particular quantity of torque. Regardless of the type of tool used, upon application of the desired amount of torque, tool 200 may be configured to provide an audible indication to a user that the desired torque level has been reached. For example, tool 200 may emit a clicking sound when the desired amount torque has been applied.

Figure 3:
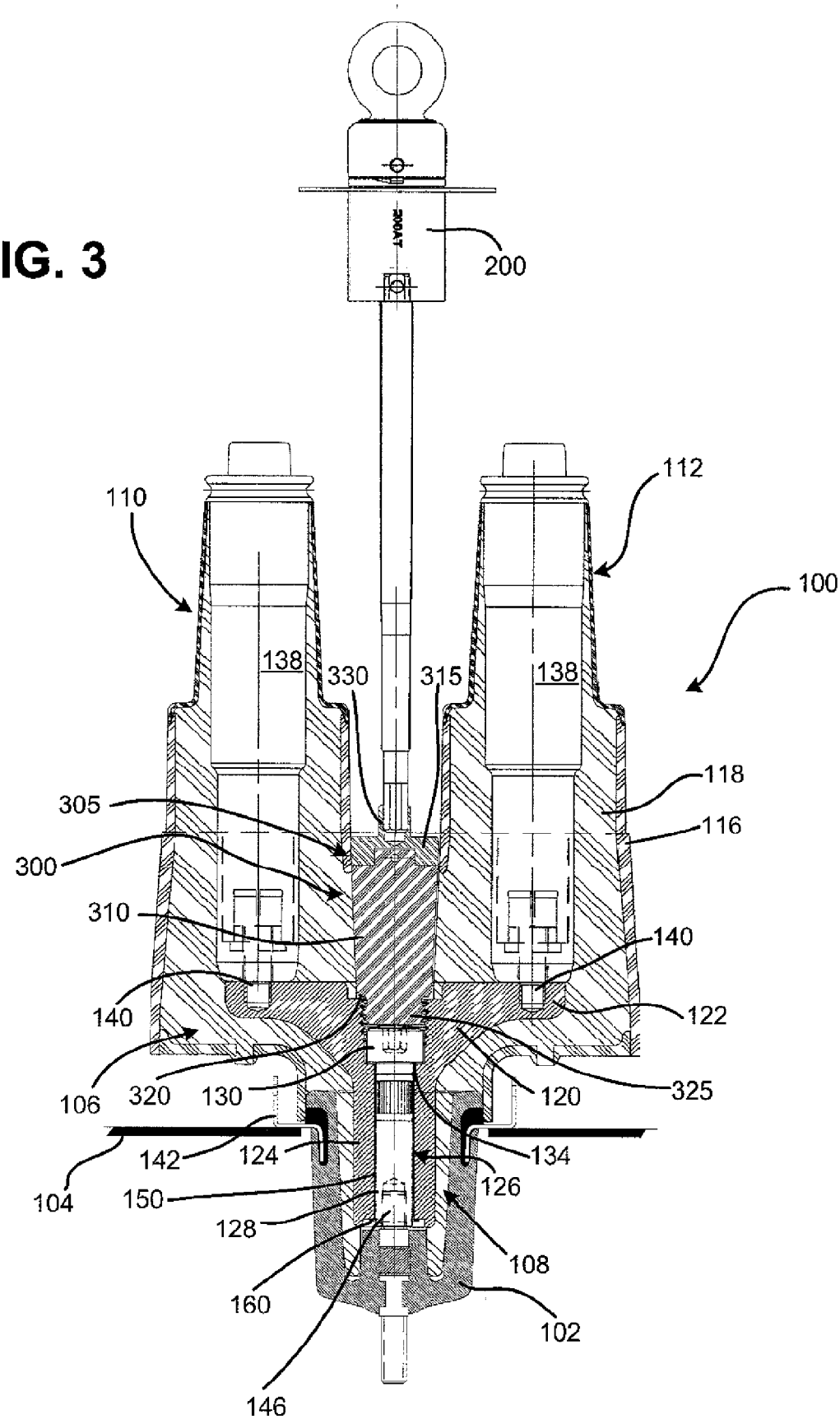
FIG. 3 is a schematic, cross-sectional diagram, of the feedthru insert assembly of FIGS. 1 and 2 following installation into a bushing well.

Following application of the desired amount of torque (also referred to as "torquing") to bolt 150, tool 200 maybe removed from feedthru insert assembly 100. FIG. 3 is a schematic, cross-sectional diagram, illustrating feedthru insert assembly 100 following installation into bushing well 102. As shown in FIG. 3, an insulating plug 300 may be inserted into a plug bore 305 formed in body portion 102 concentrically with longitudinal bore 114. As shown, insulating plug 300 may be substantially frusto-conically shaped and may include an insulating portion 310 and a drive cap portion 315. Insulating portion 310 may include a lower threaded portion 320 and a lower shoulder portion 325 and may be formed of an insulative material such as rubber or silicon. Drive cap portion 315 may be formed of a conductive material, such as copper or aluminum, and may include a tool engagement portion 330 therein. By providing insulating plug 310 with drive cap portion 315, electrical integrity of feedthru insert assembly 100 may be ensured. More specifically, T-bar portion 120 (and, therefore, portions of feedthru insert assembly 100 conductively connected to T-bar 120), may be fully insulated from grounded shield 116. Further, conductive drive cap portion 315 ensures that the grounded shield 116 completely surrounds feedthru insert assembly 100 after installation.

Following removal of tool 200 (after torquing of feedthru bolt 150), insulating plug 300 may be inserted into plug bore 305 such that lower threaded portion 320 is received into upper threaded portion 130 of T-bar bore 126. In this configuration, lower shoulder portion 320 abuts second annular shoulder portion 136 upon application of torque to drive cap portion 330 in insulating plug 300.

For example, similar to the application of torque to bolt 150, tool 200 may be inserted into drive cap portion 330 and the desired amount of torque applied to insulating plug 300. This causes lower shoulder portion 320 of insulating plug 300 to compressingly engage second annular shoulder portion 136. Tool 200 may then be removed from drive cap portion 330.

Although the torqued threaded engagement between feedthru bolt 150 and conductive stud 146 may be sufficient to prevent undesired removal of feedthru insert assembly 100 from transformer housing 104, an additional securing element may be desired in some cases, to ensure that feedthru insert 100 does not become removed in the event that heavy devices are installed on one or both of second and third legs 110/112.

Figure 4A:
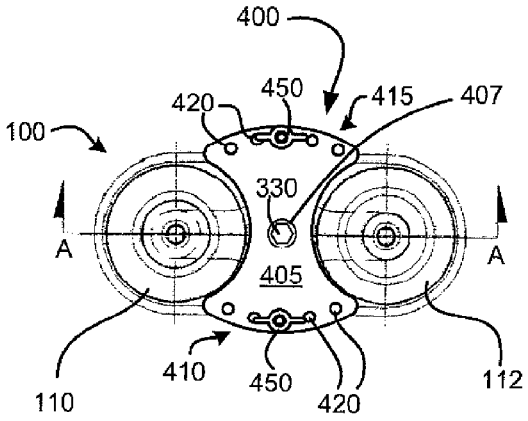
FIG. 4A is a top view of the feedthru insert assembly of FIG. 1 secured to transformer housing 104 via a bailing plate assembly consistent with implementations described herein.
Figure 4C:
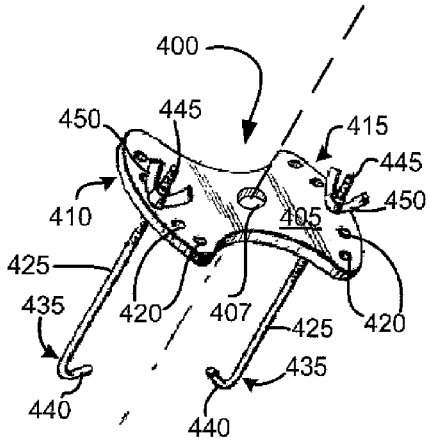
FIG. 4C is an isometric illustration of the bailing plate assembly of FIGS. 4A and 4B.
Figure 4B:
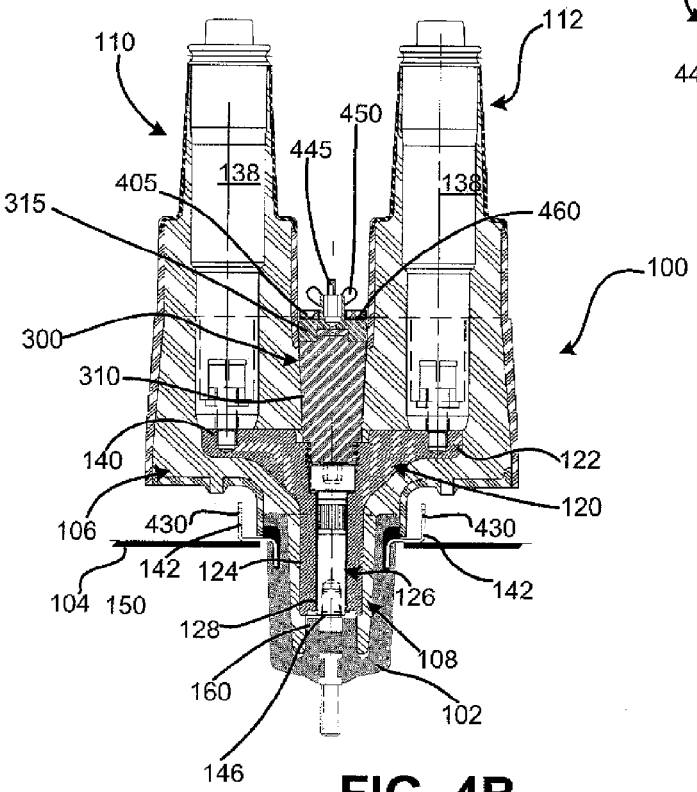
FIG. 4B is a schematic cross-sectional view of the feedthru insert assembly of FIG. 4A.

FIG. 4A illustrates a top view of feedthru insert assembly 100 secured to transformer housing 104 via a bailing assembly 400 consistent with implementations described herein. FIG. 4B is a schematic cross-sectional view of the feedthru insert assembly of FIG. 4A taken along the line A-A. FIG. 4C is an isometric illustration of bailing plate assembly 400.

As shown in FIGS. 4A-4C, bailing assembly 400 may include a substantially planar (i.e., flat) bailing plate 405 configured to fit between second and third legs 110/112. Bailing plate 405 may have opposing periphery portions 410 and 415 disposed oppositely from each other such that, following placement of bailing plate 405 on a top surface of drive cap portion 330, periphery portions 410 and 415 may project forwardly and rearwardly, respectively, from feedthru insert body portion 106.

Each of periphery portions 410 and 415 may include a number of placement holes 420 formed therethrough. As shown in FIGS. 4A and 4C, in one implementation, placement holes 420 may be formed in a spaced relationship along an outer periphery of opposing periphery portions 410/415.

To secure bailing plate 405 to transformer housing 104, a number of bailing elements 425 may connect bailing plate 405 to bailing tabs 142. For example, two or more bailing rods 425 may connect to placement holes 420 in bailing plate 405 and openings 430 in bailing tabs 142 (two of which are shown in FIG. 4B).

As depicted in FIG. 4C, bailing rods 425 may each include a hooked end 435 having a hook 440 formed thereon and a threaded end 445 distal from hooked end 435. Bailing rods 425 may have any suitable length for facilitating assembly of baling plate 405 in the manner described below. During assembly, hooked ends 435 of bailing rods 425 may be initially inserted into openings 430 of bailing tabs 142.

Because feedthru insert assembly 100 may be positioned in a number of rotational orientations with respect to bushing well 102, selection of particular ones of placement holes 420 may depend on the rotational position of feedthru insert assembly 100 relative to bushing well 102. Once particular placement holes 420 have been selected, threaded ends 445 may be inserted into the selected placement holes 420 in bailing plate 405 when bailing plate 405 is positioned body portion 106. Nuts 450 (e.g., hand tightenable wing-type nuts) may be threaded onto threaded ends 445 of bailing rods 425 and tightened, thereby securing feedthru insert assembly 100 to bushing well 102 via a compression force between bailing plate 405 and insulating plug 300.

Although described above in reference to bailing plate 405, in some implementations consistent with aspects described herein, the features of bailing plate 405 may be integral with body portion 106 of feedthru insert assembly 100. For example, body portion 106 may include tabs having placement holes 420 formed therein for receiving threaded ends 445 of bailing rods 425.

Although the present description refers to bailing rods 425 having opposing hooked and threaded ends, it should be understood that any suitable bailing element may be used, such as bailing straps or wires, clamps, a hub configuration, etc.

The above-described devices and configurations provide a low cost and effective feedthru insert assembly configuration. For example, implementations described herein provide a feedthru insert assembly that includes a central bore extending through a first leg configured for insertion into a bushing well. A conductive bolt maybe inserted through the central bore and the feedthru insert assembly may be rotated to a desired position relative to the bushing well. The conductive bolt may matingly engage a conductive stud in the bushing well. Application of a specific amount of torque to the conductive bolt may ensure that the bolt is securely fastened to the bushing well. An insulating plug may then be inserted into the feedthru insert assembly to cover the conductive bolt and ensure that the conductive bolt is fully insulated from a grounded shield that covers the feedthru insert assembly.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, implementations may also be used for other devices, such as other medium or high voltage switchgear equipment, such as any 15 kV, 25 kV, 35 kV, etc., equipment, including both dead-break-class and loadbreak-class equipment.

For example, various features have been mainly described above with respect to feedthru-type connectors. In other implementations, other medium/high voltage power components may be configured to include the rotatable configuration described above.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. An electrical connector feedthru insert assembly, comprising:

a connector body having a first leg projecting from the body in a first direction and second and third legs projecting from the body in a second direction substantially opposing the first direction, wherein the first leg is configured for insertion into a bushing well in a transformer, the bushing well including a conductive stud therein, wherein the first leg includes a longitudinal bore extending therethrough configured for alignment with the conductive stud in the bushing well upon insertion of the first leg into the bushing well, the longitudinal bore having a bolt passage portion and a first shoulder portion; and a bolt sized for insertion into the longitudinal bore and including a tool engagement shoulder portion to engage the first shoulder portion of the longitudinal bore, wherein application of rotational force to the tool engagement shoulder portion causes the bolt to threadingly engage the conductive stud.

2. The electrical connector feedthru insert assembly of claim 1, further comprising a retaining ring, wherein the retaining ring is configured for snap engagement with the bolt after the bolt is inserted through the longitudinal bore, wherein the retaining ring prevents the bolt from being removed from the longitudinal bore.

3. The electrical connector feedthru insert assembly of claim 1, wherein the body portion comprises:

a conductive T-bar portion within the body portion extending from the first leg to the second and third legs, wherein the longitudinal bore extends through the T-bar portion in the first leg.

4. The electrical connector feedthru insert assembly of claim 1, further comprising:

an insulating plug configured for insertion in the longitudinal bore following engagement of the bolt to the conductive stud.

5. The electrical connector feedthru insert assembly of claim 4, wherein the connector body comprises a conductive or semi-conductive outer shield, and wherein the insulating plug comprises an insulating portion and a conductive or semi-conductive drive cap portion to provide ground continuity for the connector body.

6. The electrical connector feedthru insert assembly of claim 4, wherein the longitudinal bore comprises a second shoulder portion and the insulating plug comprises a lower shoulder portion configured to engage the second shoulder portion in the longitudinal bore upon insertion of the insulating plug into the longitudinal bore.

7. The electrical connector feedthru insert assembly of claim 4, wherein the first shoulder portion in the longitudinal bore includes a threaded interior surface for engaging a threaded surface of the insulating plug, wherein application of rotational force to a head of the insulating plug causes the insulating plug to threadingly engage the longitudinal bore.

8. The electrical connector feedthru insert assembly of claim 1, wherein the bushing well further comprises a plurality of bailing tabs and wherein the feedthru insert assembly further comprises:

a bailing assembly for engaging the plurality of bailing tabs in the bushing well and preventing removal of the feedthru insert assembly from the bushing well.

9. The electrical connector feedthru insert assembly of claim 8, wherein the bailing assembly comprises:

a substantially planar bailing plate configured for insertion between the second and third legs, wherein a periphery of the bailing plate includes two or more holes; and a plurality of bailing rods extending between the plurality of baling tabs and the bailing plate, wherein the plurality of bailing rods are secured to the bailing plate via the two or more holes in the periphery of the bailing plate.

10. The electrical connector feedthru insert assembly of claim 1, wherein the connector body is rotatable about the bolt following insertion of the bolt and prior to tightening of the bolt to the connector stud.

11. The electrical connector feedthru insert assembly of claim 1, wherein a head of the bolt is configured to engage a torque limiting tool configure to apply a defined quantity of torque to the bolt.

12. The electrical connector feedthru insert assembly of claim 1, wherein the second and third legs comprise an interface for receiving a grounding device or a power cable elbow device.

13. A method for installing a feedthru insert assembly, comprising:

inserting a feedthru bolt through a longitudinal bore formed through a body portion of the feedthru insert assembly and a first leg portion projecting therefrom, wherein the feedthru insert assembly further comprises second and third legs portions projecting from the body portion in a direction substantially opposite to the first leg, wherein the longitudinal bore is formed substantially between the second and third legs, and wherein the longitudinal bore includes a bolt passage portion for receiving a body of the feedthru bolt and a first shoulder portion for engaging a head of the feedthru bolt;

inserting the first leg portion into a bushing well that includes a conductive stud therein so that the feedthru bolt threadingly engages the conductive stud;

rotating the body portion to a desired position; and engaging the head portion of the feedthru bolt with a torque limiting tool, to apply a determined amount of torque to the feedthru bolt, causing the feedthru bolt to secure the feedthru insert assembly to the bushing well by exerting a compression force on the first shoulder portion of the longitudinal bore.

14. The method of claim 13, wherein the first shoulder portion comprises a threaded interior surface, the method further comprising:

inserting an insulating plug having an external threaded surface into the longitudinal bore on top of the feedthru bolt so that the external threaded surface of the insulating plug engages the threaded interior surface of the longitudinal bore; and engaging a head portion of the insulating plug with the torque limiting tool, to apply the determined amount of torque to the insulating plug to secure the insulating plug to the feedthru insert assembly.

15. The method of claim 14, wherein the feedthru insert assembly comprises a conductive or semi-conductive outer shield, and wherein the head portion of the insulating plug comprises a conductive or semi-conductive material.

16. The method of claim 14, wherein the bushing well further comprises a plurality of bailing tabs, the method further comprising:

engaging a bailing assembly to the plurality of bailing tabs in the bushing well, such that the bailing assembly exerts a clamping force on the feedthru insert assembly to retain the feedthru insert assembly in the bushing well.

17. The method of claim 16, wherein the bailing assembly comprises:

a substantially planar bailing plate configured for insertion between the second and third legs, wherein a periphery of the bailing plate includes two or more holes; a plurality of bailing rods extending between the plurality of baling tabs and the bailing plate, wherein the method further comprises:

selecting holes in the bailing plate based on the rotation of the body portion and the position of the bailing tabs;

inserting bailing rods into the selected holes and the bailing tabs; and securing the bailing rods to the bailing plate to exert the clamping force.

* * * * *